US005618407A

United States Patent [19]

Kallenbach et al.

[11] Patent Number: 5,618,407

[45] Date of Patent: Apr. 8, 1997

[54] CATALYTIC CRACKING PROCESS UTILIZING A CATALYST COMPRISING ALUMINUM BORATE AND ZIRCONIUM BORATE

[75] Inventors: Lyle R. Kallenbach; Dwayne R. Senn; Marvin M. Johnson, all of Bartlesville, Okla.

[73] Assignee: Phillips Petroleum Company, Bartlesville, Okla.

[21] Appl. No.: 504,030

[22] Filed: Jul. 18, 1995

[51] Int. Cl.[6] ..... C10G 11/02

[52] U.S. Cl. ..... 208/114; 208/113; 208/120; 208/122; 502/202

[58] Field of Search ..... 208/113, 114, 208/120, 122; 502/202

[56] References Cited

U.S. PATENT DOCUMENTS

| | | | |
|---|---|---|---|
| 2,306,218 | 12/1942 | Marks | 208/114 |
| 5,071,539 | 12/1991 | Hayward et al. | 208/114 |
| 5,427,689 | 6/1995 | Kallenbach et al. | 210/670 |
| 5,461,021 | 10/1995 | Kallenbach | 502/202 |

OTHER PUBLICATIONS

Avidan et al., "Innovative Improvements Highlight FCC's Past and Future", OGJ, pp. 1–21. Jan. 1990.

*Primary Examiner*—Glenn A. Caldarola
*Assistant Examiner*—Walter D. Griffin

[57] ABSTRACT

A process for catalytically cracking a hydrocarbon-containing oil employs a cracking catalyst comprising aluminum borate and zirconium borate.

22 Claims, No Drawings

CATALYTIC CRACKING PROCESS UTILIZING A CATALYST COMPRISING ALUMINUM BORATE AND ZIRCONIUM BORATE

BACKGROUND OF THE INVENTION

This invention relates to a process for catalytically cracking hydrocarbon-containing oils employing a novel cracking catalyst composition comprising a metal borate.

Even though many catalytic cracking catalysts (especially those containing zeolites) are known, there is an ever present need to employ new catalysts which exhibit specific advantages over known catalytic cracking catalysts.

SUMMARY OF THE INVENTION

It is an object of this invention to provide a catalytic cracking processes which employs a cracking catalyst comprising a metal borate. It is another object of this invention to provide a catalytic cracking process which generates enhanced amounts of branched and cyclic monoolefins. Other objects and advantages will become apparent from the detailed description of the invention and the appended claims.

In accordance with this invention, there is provided a process for catalytically cracking a hydrocarbon-containing oil feed, substantially in the absence of added hydrogen gas, in the presence of a catalytic cracking catalyst which comprises aluminum borate and zirconium borate. In a preferred embodiment, the catalytic cracking catalyst additionally comprises at least one zeolite.

DETAILED DESCRIPTION OF THE INVENTION

The metal borate catalyst composition employed as a catalyst composition in the cracking process of this invention comprises aluminum borate and zirconium borate (preferably a coprecipitate of Al borate and Zr borate), generally at a weight ratio of Al to Zr in the range of about 2:1 to about 20:1 (preferably about 4:1 to about 12:1) and a weight ratio of(Al+Zr) to B in the range of about 1:1 to about 6:1 (preferably about 1.5:1 to about 3:1). Generally, this cracking catalyst composition has a surface area (measured by the BET method employing $N_2$) of about 150–500 $m^2/g$ and a pore volume (measured by an intrusion method employing water) of about 0.2 to about 1.5 cc/g. The particles of this cracking catalyst composition can have any suitable shape (spherical, cylindrical, trilobal or irregular) and can have any suitable particle size (preferably about 0.4–0.8 mm). When these particles have been compacted and extruded, the formed cylindrical extrudates generally have a diameter of about 1–4 mm and a length of about 3–10 mm.

The catalytic cracking catalysts composition which is employed in the process of this invention can consist essentially of borate of Al and borate of Zr (also referred to hereinafter as "Al Zr borate"). However, it is within the scope of this invention to have other materials present, such as zeolite-containing materials (which also exhibit catalytic cracking activity) or inorganic refractory oxides (in particular, alumina, silica, silica-alumina, clay, aluminum phosphate) which can be employed as binders or matrix materials), or so-called metals passivating agents (such as compounds of antimony, bismuth, tin, zirconium, tungsten, boron, phosphorus, and the like) which alleviate detrimental effects of metals (in particular Ni and/or V) that are deposited on cracking catalysts during their use in cracking of metal-contaminated oil feeds. In a preferred embodiment, the cracking catalysts comprise about 50–90 weight-% Al Zr borate, about 3–30 weight-% zeolite, and optionally about 2–20 weight-% silica-alumina (as binder). These catalyst components can be thoroughly compounded to make substantially uniform cracking catalyst particles, or the cracking catalyst can be a physical mixture of Al Zr borate particles and of particles comprising a zeolite embedded in a silica-alumina matrix.

The zeolite component, when present in the cracking catalyst composition, can be any natural or synthetic crystalline aluminosilicate zeolite which exhibits cracking activity. Non-limiting examples of such zeolites are faujasite, chabazite, mordenite, offretite, erionite, Zeolon, zeolite X, zeolite Y, zeolite L, zeolite ZSM-4, zeolite ZSM-5, zeolite ZSM-11, zeolite ZSM-12, zeolite ZSM-23, zeolite ZSM-35, zeolite ZSM-38, zeolite ZSM-48, and the like, and mixtures thereof. Additional examples of suitable zeolites are listed in U.S. Pat. No. 4,158,621. The term "zeolite", as used herein, includes zeolites which have been pretreated, such as those from which a portion of Al has been removed from the crystalline framework, and zeolites which have been ion-exchanged with rare earth metal or ammonium or by other conventional ion-exchange methods. The term "zeolite", as used herein, also includes essentially aluminum-free silica polymorphs, such as silicalite, chromiasilicates, ferrosilicates, borosilicates, and the like, as disclosed in U.S. Pat. No. 4,556,749. Generally, the zeolite component of the catalytic cracking catalyst composition is embedded in a suitable solid refractory inorganic matrix material, such as alumina, silica, silica-alumina (presently preferred), clay, aluminum phosphate, magnesium oxide, mixtures of two or more of the above-listed materials, and the like. Generally, the weight ratio of zeolite to matrix material in the catalytic cracking catalyst composition is in the range of from about 1:20 to about 1:1.

The aluminum zirconium borate catalyst composition can be prepared by any suitable method. Preferably, the first step comprises preparing a first aqueous solution containing any water-soluble, non-hydrolyzable aluminum salt (preferably aluminum nitrate), any water-soluble, non-hydrolyzable zirconium salt (preferably zirconyl nitrate) and any water-soluble, non-hydrolyzable, acidic boron compound (preferably a boric acid, more preferably $H_3BO_3$). Any suitable concentrations of these compounds in the aqueous solution can be employed, generally about 0.02–1 mole/l of each, depending on the desired Al:Zr:B ratio. Generally, the initial pH of this first aqueous solution is about 1–3. Thereafter, a second aqueous solution which is alkaline (preferably an aqueous solution of ammonia containing about 25–28 weight-% $NH_3$), generally having a pH of about 10–14, is added to the first aqueous solution in an amount sufficient to raise the pH of the first solution to above 7, preferably to about 8–9, so as to afford the coprecipitation of borates of aluminum and zirconium. The dispersion of the formed coprecipitate in the aqueous solution is then subjected to any suitable solid-liquid separation (preferably filtration) so as to substantially separate the coprecipitate from the aqueous solution. Preferably, the coprecipitate is washed with water (to remove adhered solution therefrom), optionally followed by washing with a water-soluble organic solvent such as methanol, ethanol, isopropanol (preferred), acetone and the like. The washed coprecipitate is generally dried (preferably in a vacuum oven at a temperature of about 110°–180° C. for about 2–16 hours) and is then calcined (generally in air, at a temperature of about 450°–550° C. for about 3–16 hours).

It is within the scope of this invention to mix the formed coprecipitate with a zeolite and/or with at least one carbon-containing binder material (such as polyglycol, a polyoxazoline or carbon black which is substantially burned off during the calcining step) and/or with an inorganic refractory binder material (such as alumina, silica, silica-alumina, aluminum phosphate, clays, other known inorganic binders, and mixtures thereof). It is also within the scope of this invention to disperse zeolite(s) and/or binder material(s) in the first aqueous solution (described above) before the second aqueous solution (which is alkaline; described above) is added so as to form an intimate mixture of Al Zr borate and zeolite and/or binder(s). It is within the scope of this invention to extrude or pelletize the Al Zr borate-containing material before the calcination.

In accordance with this invention, the Al Zr borate-containing catalytic cracking catalyst composition, which may or may not comprise a zeolite component and/or a binder component, is used in any catalytic cracking process, i.e., a process for catalytically cracking hydrocarbon-containing oil feedstocks, in any suitable cracking reactor. (e.g., in a FCC reactor or in a Thermofor moving bed reactor). The term "catalytic cracking", as used herein, implies that essentially no hydrocracking occurs and that the catalytic cracking process is carried out with a hydrocarbon-containing oil feed substantially in the absence of added hydrogen gas, under such conditions as to obtain at least one liquid product stream having a higher API gravity (measured at 60° F.) than the feed. The Al Zr borate-containing catalyst composition can be used alone or in admixture with fresh or used zeolite-containing catalyst composition in catalytic cracking processes.

The hydrocarbon-containing feed stream for the catalytic cracking process of this invention can be any suitable feedstock. Generally, the feed has an initial boiling point (ASTM D1160) of at least about 400° F., and preferably has a boiling range of from about 400° F. to about 1200° F., more preferably a boiling range of about 500° F. to about 1100° F., measured at atmospheric pressure conditions. Generally, this feed contains metal impurities, particularly nickel and vanadium compounds (generally in excess of about 0.01 ppm Ni and in excess of about 0.01 ppm V). The API gravity (measured at 60° F.) generally is in the range of from about 5 to about 40, preferably from about 10 to about 35. Generally, these feedstocks contain Ramsbottom carbon residue (ASTM D524; usually about 0.1–20 weight-%), sulfur (generally about 0.1–5 weight-% S), nitrogen (generally about 0.05–2 weight-% N), nickel (generally about 0.05–30 ppm Ni, i.e., about 0.05–30 parts by weight of Ni per million parts by weight of oil feed) and vanadium (generally about 0.1–50 ppm V, i.e., about 0.1–50 parts by weight of vanadium per million parts by weight of oil feed). Small amounts (generally about 0.01–50 ppm) of other metal impurities, such as compounds of Cu, Na, and Fe may also be present in the oil feed. Non-limiting examples of suitable feedstocks are light gas oils, heavy gas oils, vacuum gas oils, cracker recycle oils (light cycle oils and heavy cycle oils), residua (such as distillation bottoms fractions), and hydrotreated residua (e.g., hydrotreated in the presence of Ni, Co, Mo-promoted alumina catalysts), liquid coal pyrolyzates, liquid products from the extraction or pyrolysis of tar sand, shale oils, heavy fractions of shale oils, and the like. The presently most preferred feedstocks are heavy gas oils and hydrotreated residua.

Any suitable reactor can be used for the catalytic cracking process of this invention. Generally, a fluidized-bed catalytic cracking (FCC) reactor (preferably containing one or more risers) or a moving-bed catalytic cracking reactor (e.g., a Thermofor catalytic cracker) is employed. Preferably, the reactor is a FCC riser cracking unit. Examples of such FCC cracking units are described in U.S. Pat. Nos. 4,377,470 and 4,424,116. Generally a catalyst regeneration unit (for removal of coke deposits) is combined with the FCC cracking unit, as is shown in the above-cited patents.

Specific operating conditions of the cracking operation greatly depend on the type of feedstock, the type and dimensions of the cracking reactor and the oil feed rate. Examples of operating conditions are described in the above-cited patents and in any other publications. In an FCC operation, generally the weight ratio of catalyst composition to oil feed (i.e., hydrocarbon-containing feed) ranges from about 2:1 to about 10:1, the contact time between oil feed and catalyst is in the range of from about 0.2 to about 2.0 seconds, and the cracking temperature is in the range of from about 800° to about 1200° F. Generally, steam is added with the oil feed to the FCC reactor so as to aid in the dispersion of the oil as droplets. Generally, the weight ratio of steam to oil feed is in the range of from about 0.05:1 to about 0.5:1.

The separation of the thus employed cracking catalyst composition from gaseous and liquid cracked products (in particular hydrocarbons) and the separation of cracked products into various gaseous and liquid product fractions can be carried out by any well known, conventional separation means. The most desirable product fraction is gasoline (ASTM boiling range: about 80°–400° F.). Non-limiting examples of such separation schemes are showing in "Petroleum Refining" by James H. Gary and Glenn E. Handwerk, Marcel Dekker, Inc., 1975.

Generally, the used cracking catalyst composition which has been separated from cracked gaseous and liquid products (e.g., in a cyclone) is then regenerated, preferably by steam-stripping for removal of adhered oil and by subsequent heating under oxidizing conditions so as to burn off carbon deposits by conventional means. At least a portion of the regenerated cracking catalyst composition can then be treated by the catalyst treating process of this invention, described above. Thereafter, the regenerated and passivated catalyst is recycled to the catalytic cracking reactor, generally in admixture with fresh (unused) cracking catalyst.

It is within the scope of this invention, to add at least one known passivating agent (such as compounds of antimony, bismuth, tin, zirconium, tungsten, boron, phosphorus, and the like) to the hydrocarbon-containing oil feed stream before it enters the catalytic cracking reactor (so as to alleviate detrimental effects of metal impurities, particularly compounds of nickel and vanadium present in the oil feed). As is well known, the passivating agent can be injected either directly into the oil feed or into a slurry oil recycle stream (the highest boiling fraction of cracked products, generally containing dispersed catalyst fines) which is then combined with fresh oil feed, or the passivating agent can be injected into the oxidative regenerator (described above) where the agent comes in contact with the hot regenerated catalyst.

The following examples are presented to further illustrate this invention and are not to be considered as unduly limiting the scope of this invention.

EXAMPLE I

This example illustrates the preparation of various aluminum zirconium borate-containing compositions which were employed in catalytic cracking tests.

Catalyst A (Invention) was prepared by dissolving 13.8 grams (0.05 mole) of $ZrO(NO_3)_2 \cdot 2H_2O$ (zirconyl nitrate dihydrate; formula weight: 267), 221.7 grams (0.59 mole) of $Al(NO_3)_3 \cdot 9H_2O$ (hydrated Al nitrate; formula weight: 375) and 49.5 grams (0.80 mole) of $H_3BO_3$ (orthoboric acid; formula weight: 62) were dissolved, with stirring, in 1.5 liter of distilled water at about 60° C. To this solution was added enough concentrated aqueous ammonia to raise the pH of the solution to 8.4. A coprecipitate of Al Zr borate formed, and the solution with the coprecipitate dispersed therein was filtered. The filter cake was washed with 1.5 l of warm water and then with about the same amount of isopropanol, followed by drying in air at 150° C. and calcining for 4 hours in air at 500° C. The calcined material was ground and sieved, and the portion having a particle size in the range of 20–40 mesh was retained for testing.

Catalyst B (Invention) contained 80 weight-% Al Zr borate and 20 weight-% zeolite, and was prepared substantially in accordance with the procedure for Catalyst A, except that about 70 grams of a rare earth-exchanged zeolite Y (provided by W. R. Grace and Co., Baltimore, Md. under the product designation Davison "CS CREY") were dispersed in the aqueous solution of $ZrO(NO_3)_2$, $Al(NO_3)_3$ and $H_3BO_3$ before aqueous ammonia was added thereto (to raise the pH to 8.4 and to cause precipitation of Al Zr borate). The formed mixture of Al Zr borate and zeolite Y was filtered, dried at 110° C., calcined for 4 hours at 500° C. ground and sieved. A 20–40 mesh portion was retained. It had a surface area of about 440 $m^2/g$ (determined by the BET method) and a total pore volume of about 0.68 $m_3/g$ (determined by a water intrusion method).

Catalyst C (Invention) was prepared in essentially the same manner as Catalyst B, except that the added zeolite was a Linde LZ-Y82 catalyst (provided by UOP Inc, Des Plains, Ill.). Catalyst C contained 80 weight-% Al Zr borate and 20 weight-% zeolite.

Catalyst D (Invention) was prepared in essentially the manner as Catalyst B, except that only 35 grams of the Davison rare earth-exchanged zeolite was dispersed in the aqueous solution of $ZrO(NO_3)$, $Al(NO_3)_3$ and $H_3BO_3$. Catalyst D contained 90 weight-% Al Zr borate and 10 weight-% zeolite. The 20–40 mesh portion having a BET surface area of 350 $m^2/g$ and a total pore volume of 0.58 cc/g was retained.

Catalyst E (Control) was aluminum borate, $AlBO_3$, which had been precipitated from an aqueous solution containing $Al(NO_3)_3$ and $H_3BO_3$ by addition of aqueous $NH_3$, followed by filtration, washing with water and calcining for 15 hours in air at 500° C.

Catalyst F (Control) was zirconium borate, $Zr_3(BO_3)_4$, which had been precipitated from an aqueous solution containing $ZrO(NO_3)_2$ and $H_3BO_3$ by addition of aqueous $NH_3$, followed by filtration, washing with water and calcining in air for 15 hours at 500° C.

Catalyst G (Control) was a zeolite-containing equilibrium TCC (Thermofor) catalyst (<40 mesh) which had been used in a Utah refinery of Phillips Petroleum Company.

Catalyst H (Control) was a fresh, commercial zeolite-containing TCC catalyst (provided by Engelhard Corporation, Iselin, N.J.).

EXAMPLE II

Several of the catalyst compositions described in Example I were evaluated in a laboratory MAT cracking test apparatus, substantially as described in ASTM Method D3907, employing a hydrotreated crude oil feed having an API gravity of about 16 and containing about 5.4 weight-% Conradson carbon, about 0.5 weight-% sulfur, about 0.4 weight-% nitrogen, about 1.6 weight-% n-pentane insolubles, 1.1 ppm Ni, and about 2.4 ppm V. The MAT tests were carried out at a catalyst:oil weight ratio of about 3:1, a reaction temperature of 950° F., a reaction time of 75 seconds, a steam-stripping cycle of 10 minutes, and a regeneration cycle of 30 minutes at a temperature of 1250° F. Pertinent test results (averages of at least two measurements) are summarized in Table I. The product yields were calculated by dividing the weight of a particular product component produced per hour by the weight of the oil feed which had been converted per hour.

TABLE I

| Catalyst | % Feed Conversion | % Gasoline Yield | % Light Cycle Oil Yield | % Heavy Cycle Oil Yield | % Coke Yield | % $C_4$— Yield[1] | $iC_4/nC_4$[2] |
|---|---|---|---|---|---|---|---|
| A (Invention) | 72.4 | 43.8 | 19.0 | 8.6 | 15.1 | 13.5 | 4.3 |
| A (Invention) | 70.8 | 44.3 | 19.5 | 9.7 | 12.9 | 13.6 | 4.2 |
| A (Invention) | 71.3 | 46.9 | 19.3 | 9.4 | 12.1 | 12.7 | 3.7 |
| E (Control) | 65.7 | 43.4 | 20.3 | 14.0 | 10.6 | 11.7 | 4.0 |
| F (Control) | | | essentially no cracking occurred | | | | |
| G (Control) | 56.8 | 40.9 | 20.9 | 22.4 | 8.0 | 7.9 | 3.2 |
| H (Control) | 85.6 | 51.4 | 10.6 | 3.8 | 14.4 | 19.8 | 3.2 |

[1]Yield of $C_1$–$C_4$ hydrocarbons and hydrogen gas
[2]Volume ratio of branched $C_4$ hydrocarbons to nominal (straight-chain) C4 hydrocarbons in product Test data in Table I demonstrate the advantage of the Al Zr borate cracking catalyst (Catalyst A) over an Al borate cracking catalyst (Catalyst E): higher feed conversion. Zr borate (Catalyst F) was ineffective as a cracking catalyst. A comparison of Catalyst A with zeolite catalysts (Catalysts G and H) reveals that the invention Catalyst A exhibited catalytic cracking performances which were comparable to those of commercial zeolite-containing cracking catalysts. In addition, Catalyst A produced cracked gases having a higher ratio of branched $C_4$ hydrocarbons to normal $C_4$ hydrocarbons (which is desirable because branched $C_4$ hydrocarbons, i.e., isobutane and isobutene, are good feedstocks for alkylation, etherification and other hydrocarbon conversion reactions).

EXAMPLE III

This example illustrates additional MAT cracking tests carried out essentially in accordance with the procedure described in Example II, except that the hydrocarbon feed was slightly different. In particular, it contained more metal impurities: about 6 ppm Ni and about 8 ppm V. Test results are summarized in Table II. All product yields were calculated as defined in Example II.

TABLE II

| Catalyst | % Feed Conversion | % Gasoline Yield | % Light Cycle Oil Yield | % Heavy Cycle Oil Yield | % Coke Yield | % $C_4$— Yield[1] | Wt-% Aromatics in Gasoline | Wt-% Isoolefin in Gasoline | Wt-% Cycloolefin in Gasoline |
|---|---|---|---|---|---|---|---|---|---|
| A (Invention) | 71.3 | 46.9 | 19.3 | 9.4 | 12.1 | 12.7 | 20.8 | 29.3 | 7.3 |
| B (Invention) | 59.8 | 41.8 | 21.5 | 18.7 | 10.1 | 7.8 | 20.7 | 29.8 | 7.3 |
| C (Invention) | 59.4 | 41.7 | 21.1 | 19.5 | 9.9 | 7.8 | 25.1 | 25.6 | 4.8 |
| D (Invention) | 66.8 | 44.6 | 20.1 | 13.1 | 12.3 | 9.9 | 26.5 | 17.4 | 4.2 |
| G (Control) | 61.7 | 43.8 | 17.9 | 20.5 | 9.0 | 8.9 | 30.1 | 15.5 | 2.8 |

[1]Yield of $C_1$–$C_4$ hydrocarbons and hydrogen gas

Test data in Table II reveal the following advantages of invention Catalysts A, B and C over a zeolite-containing TCC equilibrium catalyst: lower content of aromatic hydrocarbons in the gasoline fraction (which is desirable in view of government-imposed environmental requirements to lower the aromatics content in motor fuels), and higher contents of isomonoolefins and cyclic monoolefins (which are valuable feedstocks for downstream chemical processes).

Reasonable variations, modifications, and adaptations for various usages and conditions can be made within the scope of the disclosure and the appended claims without departing from the scope of this invention.

That which is claimed:

1. A process for catalytically cracking a hydrocarbon-containing oil feed, substantially in the absence of added hydrogen gas, in the presence of a catalytic cracking catalyst which comprises a coprecipitate of aluminum borate and zirconium borate, wherein said hydrocarbon-containing oil feed has a boiling range, measured at atmospheric pressure conditions, of about 400° F. to about 1200° F.

2. A process in accordance with claim 1, wherein said catalytic cracking catalyst further comprises at least one inorganic binder material selected from the group consisting of alumina, silica, silica-alumina, clay and aluminum phosphate.

3. A process in accordance with claim 1, wherein said coprecipitate has a weight ratio of Al to Zr of about 2:1 to about 20:1.

4. A process in accordance with claim 3, wherein said coprecipitate has a weight ratio of(Al+Zr) to B of about 1:1 to about 6:1.

5. A process in accordance with claim 4, wherein said coprecipitate has a weight ratio of Al to Zr of about 4:1 to about 12:1, and a weight ratio of(Al+Zr) to B of about 1.5:1 to about 3:1.

6. A process in accordance with claim 1, wherein said catalytic cracking catalyst consists essentially of aluminum borate and zirconium borate.

7. A process in accordance with claim 1, wherein said catalytic cracking catalyst has a surface area of about 150–500 $m^2/g$ and a pore volume of about 0.2–1.5 cc/g.

8. A process in accordance with claim 1, wherein said hydrocarbon-containing oil feed contains about 0.1–20 weight-% Ramsbottom carbon residue, about 0.1–5 weight-% sulfur, about 0.05–2 weight-% nitrogen, about 0.05–30 ppm nickel and about 0.1–50 ppm vanadium.

9. A process in accordance with claim 1, wherein said process is carried out in a fluidized-bed catalytic cracking reactor.

10. A process in accordance with claim 9, wherein said process is carried out at a temperature of about 800° F. to about 1200° F. and at a weight ratio of said catalytic cracking catalyst to said hydrocarbon-containing oil feed in the range of about 2:1 to about 10:1.

11. A process in accordance with claim 10, wherein steam is added to said reactor at a weight ratio of said steam to said hydrocarbon-containing oil feed of about 0.05:1 to about 0.5:1.

12. A process for catalytically cracking a hydrocarbon-containing oil feed, substantially in the absence of added hydrogen gas, in the presence of a catalytic cracking catalyst which comprises a coprecipitate of aluminum borate and zirconium borate and at least one zeolite, wherein said hydrocarbon-containing oil feed has a boiling range, measured at atmospheric pressure conditions, of about 400° F. to about 1200° F.

13. A process in accordance with claim 12, wherein said catalytic cracking catalyst further comprises at least one inorganic binder material selected from the group consisting of alumina, silica, silica-alumina, clay and aluminum phosphate.

14. A process in accordance with claim 12, wherein said catalytic cracking catalyst comprises about 50–95 weight-% of said coprecipitate of aluminum borate and zirconium borate and about 3–30 weight-% of said at least one zeolite.

15. A process in accordance with claim 12, wherein said coprecipitate has a weight ratio of Al to Zr of about 2:1 to about 20:1.

16. A process in accordance with claim 15, wherein said coprecipitate has a weight ratio of (Al+Zr) to B of about 1:1 to about 6:1.

17. A process in accordance with claim 16, wherein said coprecipitate has a weight ratio of Al to Zr of about 4:1 to about 12:1, and a weight ratio of (Al+Zr) to B of about 1.5:1 to about 3:1.

18. A process in accordance with claim 12, wherein said catalytic cracking catalyst has a surface area of about 150–500 $m^2/g$ and a pore volume of about 0.2–1.5 cc/g.

19. A process in accordance with claim 12, wherein said hydrocarbon-containing oil feed contains about 0.1–20 weight-% Ramsbottom carbon residue, about 0.1–5 weight-% sulfur, about 0.05–2 weight-% nitrogen, about 0.05–30 ppm nickel and about 0.1–50 ppm vanadium.

20. A process in accordance with claim 12, wherein said process is carried out in a fluidized-bed catalytic cracking reactor.

21. A process in accordance with claim 20, wherein said process is carried out at a temperature of about 800° F. to about 1200° F. and at a weight ratio of said catalytic cracking catalyst to said hydrocarbon-containing oil feed in the range of about 2:1 to about 10:1.

22. A process in accordance with claim 21, wherein steam is added to said reactor at a weight ratio of said steam to said hydrocarbon-containing oil feed of about 0.05:1 to about 0.5:1.

* * * * *